US007413769B2

(12) United States Patent
McDevitt

(10) Patent No.: US 7,413,769 B2
(45) Date of Patent: Aug. 19, 2008

(54) PROCESS FOR APPLYING A METALLIC COATING, AN INTERMEDIATE COATED PRODUCT, AND A FINISH COATED PRODUCT

(76) Inventor: Erin T. McDevitt, 270 Oak St., Wind Gap, PA (US) 18034

( * ) Notice: Subject to any disclaimer, the term of this patent is extended or adjusted under 35 U.S.C. 154(b) by 401 days.

(21) Appl. No.: 11/174,329

(22) Filed: Jul. 1, 2005

(65) Prior Publication Data

US 2007/0003778 A1 Jan. 4, 2007

(51) Int. Cl.
*B05D 1/36* (2006.01)
*B05D 1/18* (2006.01)

(52) U.S. Cl. ..... 427/203; 427/435; 427/436; 427/328; 427/329; 427/205; 427/404; 427/406

(58) Field of Classification Search ..... 427/203, 427/435, 436
See application file for complete search history.

(56) References Cited

U.S. PATENT DOCUMENTS 2,049,834 A * 8/1936 Elder ..... 428/658
3,367,753 A * 2/1968 Schwendemann ..... 428/623
3,619,247 A 11/1971 Newport et al.
3,708,322 A 1/1973 Jackson et al.
4,111,154 A * 9/1978 Kissel et al. ..... 118/712
4,152,472 A 5/1979 Ohbu et al.
4,170,494 A 10/1979 Fujii et al.
4,568,569 A * 2/1986 Wang ..... 427/205
4,963,440 A 10/1990 Shimogori et al.
5,711,990 A * 1/1998 Guesdon et al. ..... 427/201
6,468,674 B2 * 10/2002 Friedersdorf et al. ..... 428/653
6,689,489 B2 * 2/2004 McDevitt ..... 428/653

FOREIGN PATENT DOCUMENTS

EP 0108877 A1 5/1984
EP 0632140 A1 1/1995
EP 1428898 A1 1/2007
FR 1328939 A 6/1963
GB 2110248 A 6/1983
JP 052476617 A 9/1993
JP 2001 158953 A 6/2001

* cited by examiner

*Primary Examiner*—Timothy Meeks
*Assistant Examiner*—David Turocy
(74) *Attorney, Agent, or Firm*—Harold I. Masteller, Jr.

(57) ABSTRACT

The present invention is directed to a method of refining spangle facet size in a hot-dip coated product by applying grain-refining particles to the surface of a steel substrate before immersion into the hot-dip coating bath, to an intermediate coated steel sheet, and to a finish coated steel sheet having a different coating spangle facet size on opposite surfaces.

27 Claims, 2 Drawing Sheets

PROCESS FOR APPLYING A METALLIC COATING, AN INTERMEDIATE COATED PRODUCT, AND A FINISH COATED PRODUCT

FIELD OF THE INVENTION

The present invention is directed to a pre-treatment process for applying a grain refining particulate compound to one surface of a steel sheet prior to immersing the steel sheet in an zinc-aluminum hot-dip coating bath, it is directed to an intermediate coated product produced by the pre-treatment process, and it is directed to a finished hot-dip coated steel sheet product with a spangle free coating applied to one surface and a conventional coating applied to the opposite surface of the steel sheet.

In the past, grain refining particulate compounds were added to a hot-dip coating bath in effective amounts to reduce the spangle facet size of the aluminum-zinc coating applied to a steel substrate. For example, U.S. Pat. No. 6,468,674 to Friedersdorf et al., and U.S. Pat. No. 6,689,489 to McDevitt, disclose a process that produces a hot-dip coated product with refined spangle size. The prior "bath added" process adds particulate compound constituents to the hot-dip coating bath; the compounds selected from a group consisting of boride compounds having one of titanium and aluminum, aluminide compounds containing titanium and iron, and carbide compounds containing titanium, vanadium, tungsten, and iron. The bath added technology disclosed by the prior patents is able to reduce the spangle facet size of the aluminum-zinc hot-dip coating applied to cold-reduced steel sheet. U.S. Pat. No. 6,468,674 and U.S. Pat. No. 6,689,489 are incorporated herein in their entirety by reference.

When such grain refining compounds are added to an aluminum-zinc hot-dip coating bath, they alter spangle appearance during solidification of the coating, and depending on their concentration level in the molten coating, they will produce a solidified spangle free coating. The term spangle free as used in the present specification refers to a spangle facet size that is not visible to the naked eye, i.e. about 0.4 mm to 0.3 mm and smaller.

Bath added grain refiners have certain intrinsic problems. For example, when grain-refining compounds are added to the hot-dip coating bath, conventional aluminum-zinc coatings, and in particular Galvalume® coatings, cannot be made on the coating line until after the grain refiner is removed from the melt (bath). One possible solution to this problem is diluting the bath after the desired amount of refined spangle product is made. However, dilution requires running the coating line continuously until the concentration of grain refiner in the melt falls to a level where conventional aluminum-zinc coatings can again be made. Such manufacturing practice is not practical because it interferes with scheduling and customer demands. The dilution method is also impractical because it produces about 3,000 tons of transitional coated product where the transitional product has a coating spangle facet size that falls between the desired refined spangle size and conventional aluminum-zinc coating and/or Galvalume spangle size.

Another possible solution for overcoming the bath added grain refiner problem is bailing the molten metal from the coating pot and replacing it with fresh conventional aluminum-zinc or Galvalume melt. A conventional aluminum-zinc melt used to hot-dip steel sheet can contain between 25% to 70% aluminum by weight. In the instance where the melt is Galvalume, it contains about 55% aluminum, 1.6% silicon, and a balance of zinc by weight. Replacing a bath added melt with fresh melt is both expensive and dangerous to workers, and bailing the pot increases the risk of equipment damage. For instance, pot inductors maintain the bath temperature at a predetermined temperature, about 440° to 460° C. (824° to 860° F.) during hot-dip coating. If bailing causes the level of the melt to fall below the inductors, the melt can freeze and damage the inductors. The thermal cycling can also damage the refractory lining of the pot.

Another problem associated with bath added grain refiners is excess consumption of expensive raw materials. When grain-refining compounds are added to the pot, the refining particles are applied to both sides of the immersed steel sheet. Aluminum-zinc coated steel sheet products, and in particular, Galvalume steel sheet products, are normally used in product applications that have only one exposed surface. For example, when Galvalume steel sheet is used as roofing or siding panels, one side of the coated sheet is exposed and the opposite side is hidden from view. In such material applications, there is no need to refine the spangle facet size on both sides of the panel. Therefore, bath added grain refiners of the past consume twice the amount of expensive raw material as compared to a Galvalume panel with refined spangle on only one side.

In addition to excess raw material consumption, the past practice of doping the hot-dip pot with a grain refiner compound is a less efficient practice because the grain refining particles are suspended throughout the molten aluminum-zinc coating on the steel substrate and the melt. Some of these particles become entrained in the oxide floating on the surface of the hot-dip bath where they are skimmed out of the bath. Other particles can nucleate undesirable dross particles within the bath and sink to the bottom of the pot. In both cases these particles are not available to grain refine the coating. In addition, the grain refining particles that are floating on the surface of the molten aluminum-zinc coating can cause undesirable surface defects whereas grain refining particles applied directly to the steel substrate surface are unlikely to contribute to poor surface appearance.

SUMMARY OF THE INVENTION

Accordingly, it is a first object of the present invention to reduce spangle facet size in an aluminum-zinc hot-dip coated steel sheet product without adding a grain refiner substance to the coating bath.

It is another object of the present invention to improve grain refining efficiency by providing nucleation sites along the surface of an intermediate coated steel sheet product.

It is another object of the present invention to provide nucleation sites along the surface of the intermediate coated product prior to hot-dip coating in an aluminum-zinc bath.

It is still another object of the present invention to provide a pre-treatment process that applies a grain refining compound to only one surface of the intermediate coated product prior to hot-dip coating in an aluminum-zinc bath.

It is another object of the present invention to mechanically bond the grain refining particles to the surface of the intermediate coated product.

It is a further object of the present invention to provide an aluminum-zinc hot dip coated steel sheet product having a spangle free aluminum-zinc coating applied to one surface and a conventional aluminum-zinc coating applied to the opposite surface of the finished coated product.

In satisfaction of the foregoing objects and advantages, the present invention includes applying a grain refining substance to at least one surface of a steel sheet, bonding the grain refining substance to the steel sheet surface, and immersing the steel sheet in an aluminum-zinc hot-dip coating bath.

DETAILED DESCRIPTION OF THE INVENTION

Figure 1:
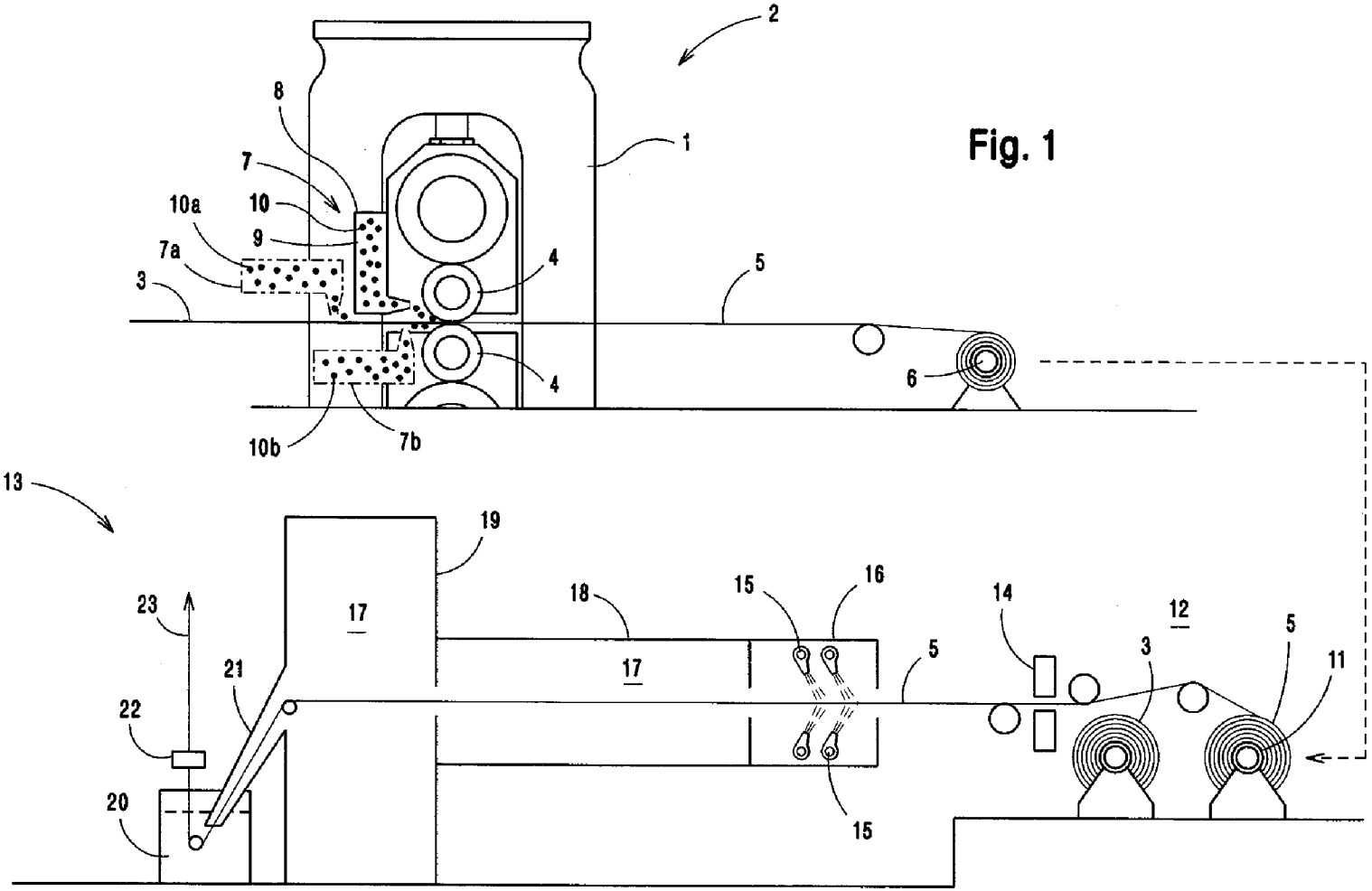
FIG. 1 is a schematic view showing a pre-treatment process that applies grain-refining particles to a steel sheet being reduced in a rolling mill.

Referring to the drawings, FIG. 1 shows the preferred pre-treatment process of the present invention applying grain-refining particles to steel sheet being rolled in a cold-reduction mill. Cold-reduction is a process that reduces the thickness of steel sheet in a series of passes through a single-stand reversing mill, or a series of continuous passes through an arrangement of spaced apart mill stands in a tandem mill. During cold rolling, the reduction of the steel sheet thickness at high speed generates considerable heat and raises the temperature of both the sheet and the work rolls. The generated heat is usually dissipated with a flood lubrication system that directs a rolling solution that may include, for example, tallow based or synthetic oil, a mixture of oils, or a detergent in small streams or jets against the rolls and steel sheet surface. Flood lubrication systems are able to maintain the work temperature of the steel sheet at about 650° to 120° C. (150° to 250° F.). FIG. 1 shows the last, or exit mill stand 1 in an exemplary tandem cold-reduction mill 2 that includes multiple mill stand arrangements. The steel sheet 3 receives a last reduction as it passes between work rolls 4 in the last mill stand 1, and the full-hard cold rolled steel sheet product 5 is fed onto a reel 6 where it is coiled and wrapped for shipping to a customer and/or storage.

The mill stand lubrication system 7 includes a reservoir 8 that contains a mixture of oil or detergent solution 9 and grain refining particles 10. The grain refining particles have a particle size range of about 0.01 and about 25 microns. The liquid mixture is directed against the work rolls 4 and the steel sheet 3 to reduce work temperature and distribute the grain refining particles 10 across the width of the steel sheet before its final pass between work rolls 4. Pressure exerted by the last set of work rolls 4 mechanically bonds the distributed particles 10 to the surface of the steel sheet during the final roll pass. This produces an intermediate coated product 5 with a grain refining particulate compound constituent bonded to one surface of the steel sheet. The intermediate coated product is fed onto the take-up reel 6 where it is coiled and wrapped for shipping to a hot-dip coating line.

In the instance where the intermediate coated product 5 is delivered to a hot-dip coating line for immersion into a molten aluminum-zinc alloy coating bath, the grain refining particulate compound constituent that is bonded to the surface of the intermediate product is boride, carbide or aluminide, as disclosed in U.S. Pat. Nos. 6,468,674 and 6,689,489 that are incorporated herein by reference. Preferably, the boride compounds include titanium boride ($TiB_2$), and aluminum boride ($AlB_2$ and $AlB_{12}$). The particulate compound constituent as a carbide is titanium carbide, vanadium carbide, tungsten carbide, and iron carbide, and the aluminide is titanium aluminide ($TiAl_3$) and iron aluminide. The particulate compound constituent is bonded to the intermediate product in an amount that effectively reduces spangle facet size when compared to conventional aluminum-zinc alloy coatings. The effective amount is with or without elemental titanium. The preferred effective amount of selected grain refining compound will reduce spangle facet size to about 0.04 to 0.03 mm and smaller so that when the intermediate coated product is hot-dipped coated, the finished coated product will have a spangle free coating on one surface and a conventional aluminum-zinc coating on the opposite surface of the coated product. The effective amount of grain refiner will vary depending on which compound is selected for the intermediate coated product and depending on the desired hot-dip coating weight of the finished coated product.

Table A shows a range of surface concentrations for the above mentioned preferred grain refining particles that will produce a total concentration of bonded particles equivalent to the bath added compositions disclosed in the incorporated references. The bonded surface concentration depends on the aim coating weight (CW) for the desired finished coated product.

TABLE A

| | Bath Composition U.S. Pat. No. 6,468,674 and 6,689,489 | | Intermediate Product Bonded Surface Concentration g/m$^2$ | |
|---|---|---|---|---|
| Grain Refiner | Min | Max | Min | Max |
| $TiB_2$ | 0.001 wt % B | 0.5 wt % B | 3.23E−5 * CW[1] | 0.016 * CW |
| $AlB_2$ | 0.001 wt % B | 0.5 wt % B | 2.25E−5 * CW | 0.011 * CW |
| $AlB_{12}$ | 0.001 wt % B | 0.5 wt % B | 1.21E−5 * CW | 0.006 * CW |
| TiC | 0.0005 wt % C | 0.01 wt % C | 2.50E−5 * CW | 0.0005 * CW |

[1]Coating weight (CW) measured in g/m$^2$.

The CW range of the finished coated product is about 30 to 300 g/m$^2$ having an aluminum content of between 25% to 70% Al by weight and a preferred aluminum content of 55% Al by weight for a hot-dip Galvalume coatings applied to the finished coated product.

The shipped coil of intermediate coated product 5 is placed on reel 11 at the entry end 12 of a hot-dip coating line 13, and the leading end of coil 5 is welded, at welding station 14, to the trailing end of the sheet steel being coated in the continuous hot-dip coating line 13. The incoming intermediate coated product 5 can be spliced to the trailing end of either conventional cold rolled steel sheet that has not been pre-treated according to the present invention, or to steel sheet that has been pre-treated according to the present invention (other intermediate coated product).

The spliced-in intermediate coated product 5 passes between gas-fired burners 15 housed within the chamber 16 of a direct-fired furnace. The rolling oil that was applied to the intermediate coated product during cold-reduction is burned off in chamber 16 leaving behind a layer of de-oiled grain refining particles bonded to one surface of intermediate product.

The de-oiled intermediate coated product 5 enters an annealing furnace 18 that contains a reducing atmosphere mixture 17 of about 5% to 6% hydrogen, the balance nitrogen. The temperature of the steel sheet is raised to about 760° C. (1400° F.) and then it is cooled in the cooling section 19 of the coating line to bath temperature, about 593° C. (1100° F.) for a Galvalume hot-dip bath. The annealed intermediate product 5 enters the hot-dip bath 20 through snout 21 to prevent exposing it to the atmosphere, and it is immersed in bath 20 where both surfaces of the steel sheet receive a coating of molten metal (aluminum-zinc alloy). Surprisingly, the bonded grain refining particles do not contaminate or alter the hot-dip bath composition. The molten metal coated steel sheet exits bath 20 between gas-wipe apparatus 22 where the molten metal coating begins to solidify. When fully solidified, finished coated product 23 has an aluminum-zinc alloy coating with a refined spangle facet size on one side of the steel sheet, and a conventional aluminum-zinc alloy coating with a larger spangle facet size on the opposite side of the steel sheet, and the finished coated product is sent downstream for additional processing and/or shipping to a customer.

Because the intermediate coated product does not contaminate the hot-dip pot with grain refining particles, the present invention is an improvement that satisfies a long felt need in the art. A coating line is now able to produce conventional aluminum-zinc alloy coatings and refined spangle aluminum-zinc alloy coatings on demand, in the same coating bath. Bath added methods of the past failed to provide such product flexibility.

Referring again to the last mill stand 1 in the tandem cold-reduction mill 2 shown in FIG. 1, a first alternate embodiment of the present invention includes a particle distribution system 7*a* that applies the grain refining particles 10*a* to one surface of the steel sheet 3 separate from the rolling oil 9 applied by the mill stand lubrication system 7. The grain refining particles 10*a* are distributed across the width of the oiled steel sheet before it makes its final pass through the mill stand work rolls 4. Pressure exerted by the work rolls mechanically bonds particles 10*a* to the surface of the steel sheet producing an oiled, intermediate coated product 5 with a grain refining particulate compound constituent bonded to one surface. The intermediate coated product is fed onto the take-up reel 6 where it is coiled and wrapped for shipping to a hot-dip coating line.

Referring again to the last mill stand in FIG. 1, a second alternate embodiment of the present invention includes apparatus 7*b* for applying grain-refining particles to the opposite or bottom surface of steel sheet 3. In this arrangement grain refining particles 10*b* and rolling oil is applied to the bottom surface of the steel sheet 3 in a mixture similar to the preferred embodiment, or alternatively, the grain refining particles are applied to the bottom surface of the steel sheet 3 separate from the rolling oil similar to the first alternate embodiment of the present invention. In either case, pressure exerted by the last work rolls 4 mechanically bonds the distributed particles 10*a* to the surface of the steel sheet during the final roll pass, producing an oiled, intermediate coated product 5 having a grain refining particulate compound constituent bonded to both surfaces of the steel sheet. However, as mentioned above, except for special material applications, bonding grain-refining particles to both sides of the intermediate coated product consumes excessive amounts of grain refining material. Therefore, such an intermediate coated product is less desirable than the preferred intermediate coated product that has grain refining particles bonded to only one surface.

Figure 2:
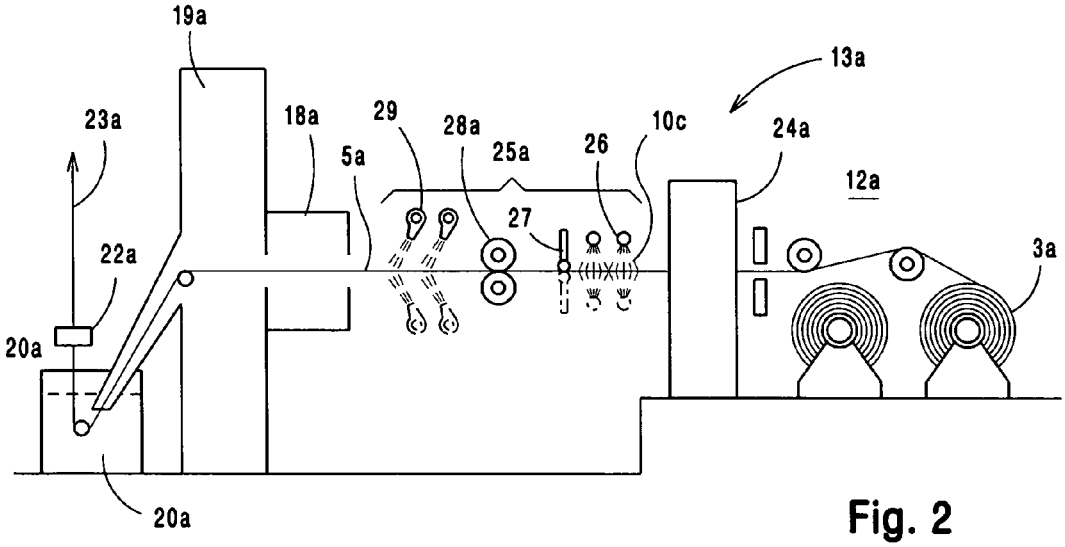
FIG. 2 is a schematic view showing a pre-treatment process that applies a liquid mixture containing grain-refining particles to a steel sheet in a hot-dip coating line.

A third alternate embodiment of the present invention is shown in FIG. 2. In certain hot-dip coating lines 13*a*, the incoming full-hard cold rolled steel sheet is cleaned with solvents or the like before hot dipping, not de-oiled with gas-fired burners as shown in the FIG. 1 preferred embodiment. In such continuous hot-dip coating lines, coiled sheet steel product 3*a*, that has not yet been pre-treated according to the present invention, is placed on reel 11*a* at entry end 12*a*. The sheet steel 3*a* enters a cleaning station 24*a* where the rolling oil is removed and the surface of the steel sheet is prepared for hot-dip coating. The steel sheet moves into a pre-treatment station 25*a* where a grain refining particulate compound constituent is applied preferably to one surface, or alternatively to both surfaces of the steel sheet to produce the intermediate coated product 5*a*. The grain refining compound particles measure between 0.01 and about 25 microns, and the particles are suspended in a liquid carrier. Nozzles 26 distribute the liquid mixture 10*c* containing grain refining particles across the width of the steel sheet. The liquid carrier may be an aqueous solution such as water with a surfactant, a volatile organic compound (VOC), or any other suitable solution with good wetting properties and that will evaporate quickly. It should be understood that although the drawing shows nozzles 26 distributing the liquid mixture 10*c* onto the steel sheet surface, any suitable means known in the art for applying the liquid mixture to the steel sheet surface may be used without departing from the scope of the present invention.

An optional squeegee roll 27 is used to meter the solution and improve the distribution of grain refining particles on the surface of the steel sheet, and rolls 28*a* apply pressure to mechanically bond the grain refining particles to the surface. Blowers 29 vaporize the carrier before the intermediate coated product 5*a* enters the reducing atmosphere contained within annealing furnace 18*a*. The annealed steel sheet 5*a* is cooled to bath temperature in cooling section 19*a*. It is immersed in the molten aluminum-zinc alloy bath 20*a*, exits the bath as a finished coated product between gas wiped with knives 22*a*. The finished coated product 23*a* has an aluminum-zinc alloy coating with a refined spangle size on one side of the steel sheet and a conventional aluminum-zinc alloy coating, with a larger spangle size, on the opposite side of the steel sheet. The finished coated steel sheet is coiled and wrapped for shipping to a customer.

Table B shows test results for two different concentration levels of $TiB_2$ particles suspended in a carrier solution. The first mixture contained 0.66 g of $TiB_2$ powder having a particle size of less than 10 microns in a solution of 20 ml ethanol, and 60 ml water (Solution 1). The second mixture contained 1.94 g of the same $TiB_2$ powder in the same carrier solution (Solution 2). The test panels were 0.05 cm (0.0182 inch) thick annealed steel sheet, de-oiled with an alkaline cleaner, and Scotch-Brite® cleaned to prepare the surface for hot-dip coating and improve wettability. One side of each test panel 1-6 was treated with 1 ml of Solution 1, and one side of each test panel 7-12 was treated with 1 ml of Solution 2. Test panels 13 and 14 were not treated with Solutions 1 and 2; one side of each panel was lightly brushed with dry Ti $B_2$ particles and then rolled to mechanically bond the dry particles to the surface of the test panels 13 and 14 before hot-dip coating in the test melt described below.

The solutions applied to test panels 1-12 were spread with a drawdown bar and then dried under an infrared lamp. The pre-treated panels 1-14 were annealed at 760° C. (1400° F.) for two minutes in a 6% $H_2$ balance $N_2$ atmosphere and cooled to about 593° C. (1100° F.) to simulate hot-dip coating line conditions before coating. The treated samples were dipped into a test melt for 4 seconds. The test melt was a standard Galvalume bath having a temperature of about 593° C. and a nominal composition containing 55 Al, 1.8% Si, balance Zn. Untreated control panels were dipped into the test melt before and after the test panels 1-14 were coated to determine if the coating bath was contaminated by the pre-treatment grain refining particles.

TABLE B

| Panel ID | Panel Surface | Spangle Refining Surface Pretreatment | Rolling Treatment | Spangle Facet Size μm | Comment |
|---|---|---|---|---|---|
| TC | Top | None | Not Rolled | 674.9 | Thermocouple panel used to verify thermal cycle prior to starting the test. Typical Al—Zn coating spangle. |
| | Bottom | None | Not Rolled | 898.2 | |
| 1 | Top | Solution 1 | Not Rolled | Not Measured | No visible spangle |
| | Bottom | None | Not Rolled | Not Measured | Typical Al—Zn coating spangle |
| 2 | Top | Solution 1 | Not Rolled | Not Measured | No visible spangle |
| | Bottom | None | Not Rolled | Not Measured | Typical Al—Zn coating spangle |
| 3 | Top | Solution 1 | Not Rolled | 198.4 | No visible spangle |
| | Bottom | None | Not Rolled | 860.2 | Typical Al—Zn coating spangle |
| 4 | Top | Solution 1 | Rolled | Not Measured | No visible spangle |
| | Bottom | None | Rolled | Not Measured | Typical Al—Zn coating spangle |
| 5 | Top | Solution 1 | Rolled | 167.8 | No visible spangle |
| | Bottom | None | Rolled | 821.6 | Typical Al—Zn coating spangle |
| 6 | Top | Solution 1 | Rolled | Not Measured | No visible spangle |
| | Bottom | None | Rolled | Not Measured | Typical Al—Zn coating spangle |
| 7 | Top | Solution 2 | Not Rolled | Not Measured | No visible spangle |
| | Bottom | None | Not Rolled | Not Measured | Typical Al—Zn coating spangle |
| 8 | Top | Solution 2 | Not Rolled | 193.5 | No visible spangle |
| | Bottom | None | Not Rolled | 811.2 | Typical Al—Zn coating spangle |
| 9 | Top | Solution 2 | Not Rolled | Not Measured | No visible spangle |
| | Bottom | None | Not Rolled | Not Measured | Typical Al—Zn coating spangle |
| 10 | Top | Solution 2 | Rolled | Not Measured | No visible spangle |
| | Bottom | None | Rolled | Not Measured | Typical Al—Zn coating spangle |
| 11 | Top | Solution 2 | Rolled | Not Measured | No visible spangle |
| | Bottom | None | Rolled | Not Measured | Typical Al—Zn coating spangle |
| 12 | Top | Solution 2 | Rolled | 159.0 | No visible spangle |
| | Bottom | None | Rolled | 758.4 | Typical Al—Zn coating spangle |
| 13 | Top | $TiB_2$ Powder Brushed on Surface | Rolled | Not Measured | Non-uniform visible and invisible spangle associated with non-uniform powder application |
| | Bottom | None | Rolled | Not Measured | Typical Al—Zn coating spangle |
| 14 | Top | $TiB_2$ Powder Brushed on Surface | Rolled | Not Measured | Non-uniform visible and invisible spangle associated with non-uniform powder application |
| | Bottom | None | Rolled | Not Measured | Typical Al—Zn coating spangle |
| 15 | Top | None | Not Rolled | Not Measured | Control panel dipped after completion of spangle refining test. Typical Al—Zn coating spangle |
| | Bottom | None | Not Rolled | Not Measured | |
| 16 | Top | None | Not Rolled | 880.7 | Control panel dipped after completion of spangle refining test. Typical Al—Zn coating spangle |
| | Bottom | None | Not Rolled | 838.4 | |
| SLEEKAZ ® | Benchmark, commercially produced sample | | | 203.04 | U.S. Pat. No. 6,440,582 product |

Based on the above test results, it is anticipated that the present pre-treatment process is able to reduce conventional aluminum-zinc spangle (about 700 to 900 microns) down to a spangle facet size that is less than 200 microns, with a preferred reduced spangle facet size range between about 50 to 500 microns (0.05 mm to 0.5 mm).

Figure 3:
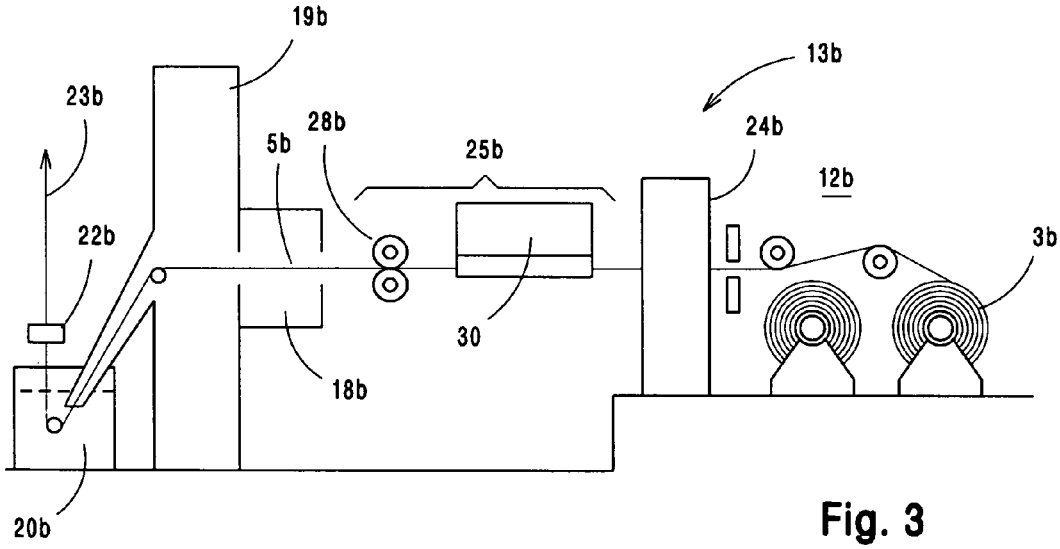
FIG. 3 is a schematic view showing a pre-treatment process that uses a fluidized bed to apply grain-refining particles to a steel sheet in a hot-dip coating line.

In a fourth alternate embodiment shown in FIG. 3, a coil of untreated cold rolled steel sheet 3*b* is fed onto the entry end 12*b* of the continuous hot-dip coating line 13*b* and is prepared for hot-dip coating at cleaning station 24*b*. The de-oiled and prepared steel sheet enters pre-treatment station 25*b* where a fluidized bed 30 distributes a grain refining particulate compound constituent in the form of a powder across the width of steel sheet to produce the intermediate coated product 5*b*. The grain refining powder has a particle size between 0.01 and about 25 microns. The coated steel sheet exits fluidized bed 30 between rolls 28*b* that apply pressure to mechanically bond the grain refining particles to the steel sheet surface. The intermediate coated product 5*b* is annealed in furnace 18*b*, and then cooled to bath temperature in cooling section 19*b*. The cooled sheet is immersed in the molten aluminum-zinc alloy bath 20*a*, gas wiped with knives 22*b* and the finished coated product 23*b*, having an aluminum-zinc alloy coating with a refined spangle size on one side, and a conventional aluminum-zinc alloy coating with a larger spangle size on the opposite side, is coiled and wrapped for shipping to a customer.

Figure 4:
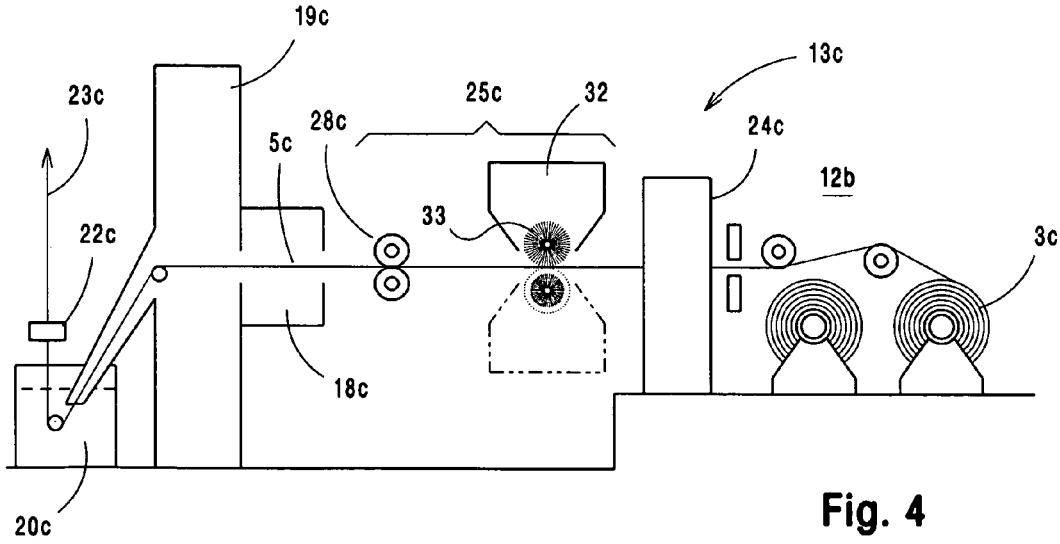
FIG. 4 is a schematic view showing a pre-treatment process that uses a brush or roll apparatus to apply grain-refining particles to a steel sheet in a hot-dip coating line.

Referring to FIG. 4 showing a fifth alternate embodiment, a coil of untreated cold rolled steel sheet 3*c* is fed into the entry end 12*c* of the continuous hot-dip coating line 13*c* and is prepared for hot-dip coating at cleaning station 24*c*. The de-oiled and prepared steel sheet enters the pre-treatment station 25*c* where the intermediate coated product 5*a* is produced by brushing or rolling a coating of grain refining particulate compound constituent in powder form onto the sheet steel. A brush or roll 33 distributes grain-refining powder fed from a hopper 32 onto the steel surface. The brushed grain refining powder has a particle size between 0.01 and about 25 microns. The powder coated steel sheet passes between rolls 28*c* that apply pressure to mechanically bond the grain refining particles to the steel sheet surface. One or both sides of the steel sheet may be coated with the grain refining powder as shown in the drawing figure, However, coating one surface of the cold rolled steel sheet with grain refiner powder is preferred. The intermediate coated product 5*c* is annealed in furnace 18*c*, and the annealed intermediate coated product 5*c* is cooled to bath temperature in cooling section 19*b*. The cooled sheet is immersed in the molten aluminum-zinc alloy bath 20*c*, gas wiped with knives 22*c*, and the finished coated product 23*c*, having an aluminum-zinc alloy coating with a refined spangle size on one side of the coated steel sheet, and a conventional aluminum-zinc alloy coating with a larger spangle size on the opposite side of the coated steel sheet, is sent downstream for further processing and/or shipping to a customer.

The grain refining particulate compound constituent that is mechanically bonded to the steel sheet substrate in the alternate embodiments shown in FIGS. 2, 3, and 4 is preferably one of the boride, carbide or aluminide compounds heretofore disclosed above. In addition, although FIGS. 2-4 show pretreating the steel sheet 3*a*-3*c* after the incoming sheet is de-oiled and prepared for hot-dip coating at cleaning stations 24*a*-24*c* to produce intermediate coated products 5*a*-5*c*, it should be understood that such grain refining pre-treatment may be applied to conventional cold rolled steel sheet in a continuous hot-dip coating line similar to coating line 13 shown in FIG. 1. In such an alternate embodiment of the present invention, the grain refining particulate compound constituent would be applied to at least one surface of incoming oiled cold rolled steel sheet before the incoming sheet enters the direct-fired furnace 16 for de-oiling.

As such, an invention has been disclosed in terms of preferred embodiments thereof, which fulfills each and every one of the objects of the present invention as set forth above and provides new intermediate coated product, a new and improved finished coated steel product, a method of making the coated products.

Of course, various changes, modifications, and alterations from the teachings of the present invention may be contemplated by those skilled in the art without departing from the intended spirit and scope thereof. It is intended that the present invention only be limited by the terms of the appended claims.

I claim:

1. A method of refining spangle facet size on a hot-dip coated steel substrate, the steps of the method comprising:

a) applying a intermediate coating of grain-refining particles to a surface of the steel substrate;

b) immersing the intermediate coated steel substrate into a hot-dip coating bath and applying a molten aluminum-zinc alloy coating;

c) removing the steel substrate from the hot-dip coating bath;

d) solidifying said molten aluminum-zinc alloy coating applied to the steel substrate, the intermediate coating of grain-refining particles refining spangle facet size during solidification of the molten aluminum-zinc alloy coating.

2. The method recited in claim 1 including the further step of rolling the steel substrate to mechanically bond said grain-refining particles to said surface before immersing into the hot-dip coating bath.

3. The method according to claim 1 wherein said solidified aluminum-zinc alloy coated steel substrate has a first coated surface with a refined spangle facet size and a second coated surface with a larger spangle facet size.

4. The method according to claim 3 wherein said refined spangle facet size measures less than 700 microns.

5. The method according to claim 3 wherein said refined spangle facet size measures between about 50 and 500 microns.

6. The method according to claim 3 wherein said first coated surface is spangle free.

7. The method recited in claim 1 wherein said applied grain refining particles comprise a particulate compound constituent selected from the group consisting of boride compounds having one of titanium and aluminum, aluminide compounds containing titanium and iron, and carbide compounds containing titanium, vanadium, iron, and tungsten.

8. The method recited in claim 7 wherein said particulate compound constituent is one of TiC, $TiB_2$, $AlB_2$, $AlB_{12}$, and $TiAl_3$.

9. The method recited in claim 1 wherein said applied grain refining particles measure between about 0.01 microns and about 25 microns.

10. The method according to claim 1 wherein said grain refining particles are suspended in a liquid mixture applied to said surface.

11. The method according to claim 1 wherein the hot-dip coating bath contains between 25% to 70% aluminum by weight.

12. The method according to claim 1 wherein the hot-dip coating bath contains about 55% aluminum by weight.

13. The method recited in claim 1 wherein said intermediate coating of grain-refining particles is applied to two surfaces of the steel substrate.

14. In a cold-reduction mill, a method of producing an intermediate coated product to be utilized in a downstream hot-dip coating in an aluminum-zinc alloy bath, the steps of the method comprising:

a) applying a coating of grain-refining particles to a surface of a steel sheet being rolled in the cold-reduction mill;

b) rolling the steel sheet to mechanically bond said grain-refining particles to the surface of said intermediate coated product.

15. The method recited in claim 14 wherein step b) includes rolling the steel sheet between work rolls in the cold-reduction mill to bond said grain-refining particles to said surface.

16. The method recited in claim 14 wherein said grain-refining particles are suspended in a rolling solution and applied to said surface.

17. The method recited in claim 14 wherein said grain-refining particles comprise a particulate compound constituent selected from the group consisting of boride compounds having one of titanium and aluminum, aluminide compounds containing titanium and iron, and carbide compounds containing titanium, vanadium, iron, and tungsten.

18. The method recited in claim 17 wherein said particulate compound constituent is one of TiC, $TiB_2$, $AlB_2$, $AlB_{12}$, and $TiAl_3$.

19. The method recited in claim 14 wherein said applied grain refining particles measure between about 0.01 microns and about 25 microns.

20. The method recited in claim 14 wherein said applied grain refining particles are applied to two surfaces of the steel sheet being rolled in the cold-reduction mill.

21. The method recited in claim 16 including the further steps of:

a) removing the rolling solution from said intermediate coated product;

b) immersing said intermediate coated product into a hot-dip coating bath and applying a molten aluminum-zinc alloy coating;

c) removing the aluminum-zinc alloy coated product from the hot-dip coating bath;

d) solidifying said molten aluminum-zinc alloy coating, the applied grain-refining particles refining spangle facet size during solidification.

22. The method according to claim 21 wherein said solidified aluminum-zinc alloy coated product has a first coated surface with a refined spangle facet size and a second coated surface with a larger spangle facet size.

23. The method according to claim 22 wherein said refined spangle facet size measures less than 700 microns.

24. The method according to 22 wherein said refined spangle facet size measures between about 50 and 500 microns.

25. The method according to claim 22 wherein said first coated surface is spangle free.

26. The method according to claim 21 wherein the hot-dip coating bath contains between 25% to 70% aluminum by weight.

27. The method according to claim 21 wherein the hot-dip coating bath contains about 55% aluminum by weight.

* * * * *